US007350527B2

(12) United States Patent
Gurubatham et al.

(10) Patent No.: US 7,350,527 B2
(45) Date of Patent: Apr. 1, 2008

(54) DISHWASHER FILTER SYSTEM

(75) Inventors: Vincent P. Gurubatham, St. Joseph, MI (US); Joseph K. Sharkey, Niles, MI (US); Aaron M Torberg, Windham, ME (US); Robert H. Ashton, Watervliet, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 546 days.

(21) Appl. No.: 10/885,146

(22) Filed: Jul. 6, 2004

(65) Prior Publication Data

US 2006/0005863 A1 Jan. 12, 2006

(51) Int. Cl.
*B08B 3/04* (2006.01)
*B08B 3/02* (2006.01)

(52) U.S. Cl. ..... 134/104.1; 134/58 D

(58) Field of Classification Search ..... 134/104.1
See application file for complete search history.

(56) References Cited

U.S. PATENT DOCUMENTS 3,989,054 A * 11/1976 Mercer ..... 134/104.1
4,418,868 A * 12/1983 Gurubatham et al. ..... 239/228
5,345,957 A * 9/1994 Cooper et al. ..... 134/104.1
5,700,329 A * 12/1997 Edwards et al. ..... 134/10
6,234,184 B1 * 5/2001 Tuller et al. ..... 134/104.1

* cited by examiner

*Primary Examiner*—Michael Barr
*Assistant Examiner*—Jason P. Riggleman
(74) *Attorney, Agent, or Firm*—Tara M. Hartman; John Morrison; Clifton Green

(57) ABSTRACT

A filter system for dishwasher with a sump having inlets leading to a wash pump and a drain pump in the bottom wall. The filter assembly includes a vertical filter retainer an overlying perforate hood, a multiple porosity filter element carried on the filter retainer and a back wash sprayer rotatably mounted inside the filter retainer with at least one backwash nozzle directed toward the filter assembly. The inlet leading to the wash pump is positioned inside the filter element and the inlet to the drain pump is located outside the filter element. The filter element has openings that vary in size from the top to the bottom of the filter element. The filter element openings can be arranged in bands of different porosity openings including fine, medium and coarse porosity openings. The perforate hood can have coarse porosity openings.

22 Claims, 12 Drawing Sheets

DISHWASHER FILTER SYSTEM

BACKGROUND OF THE INVENTION

1. Field of the Invention

The invention relates to a micron filter system for a dishwasher having a wash pump and a drain pump.

2. Description of the Related Art

Dishwashers have filters to reduce the amount of food particles recirculated and potentially re-deposited on dishes being washed. Prior art dishwasher filter configurations have employed micron filters to improve cleaning performance of the dishwasher. Typically, such micron filters are bypass filters in which only a portion of the wash water being recirculated in the dishwasher during wash and rinse cycles passes through the micron filter to reduce filter clogging and impaired performance. Another approach to the use of micron filters is to provide frequent flushing of soil particles to drain, again to reduce filter clogging. A disadvantage of multiple flushing cycles is increased hot water and energy usage.

SUMMARY OF THE INVENTION

In one aspect of the invention a filter system for a dishwasher can be positioned in a sump in the floor is the dishwasher. The bottom wall of the sump can have an inlet leading to a wash pump and an inlet leading to an inlet to a drain pump. The filter assembly can be positioned in the sump and can include a generally vertical filter retainer and an overlying perforate hood. A multiple porosity filter element can be carried on the filter retainer. A back wash sprayer connected to the wash pump can be positioned inside the filter retainer and can have at least one nozzle directed toward the filter element. The inlet leading to the wash pump can be inside the filter assembly and the inlet leading to the drain pump can be outside the filter assembly.

In another aspect of the invention the filter element can include openings that vary in size from the top to the bottom of the filter.

In another aspect of the invention the openings in the filter element can vary from fine porosity openings at the top and coarse porosity openings at the bottom of the filter element.

In another aspect of the invention the filter element can have three vertically arranged bands of differing porosity openings with the top band having fine porosity openings, the middle band having medium porosity openings and the bottom band having coarse porosity openings.

In another aspect of the invention the top band can have medium porosity openings and the middle band can have fine porosity openings.

In another aspect of the invention the openings in the filter element can vary in size substantially continuously from top to bottom.

In another aspect of the invention the perforate hood can include a plurality of openings having porosity equal to or greater that the most porous openings of the filter element.

In another aspect of the invention the bottom wall of the sump can define a ramped channel between the sidewall of the sump and the filter element with the drain pump inlet positioned at the low point of the ramped surface.

In another aspect of the invention the dishwasher can include a control and a sensor positioned in the sump to detect accumulation of soil particles on the filter element. The control can be arranged to activate the drain pump to remove soil particles when a predetermined accumulation of soil particles is detected.

In another aspect of the invention a dishwasher can have a floor and a plurality of walls, a wash pump, a drain pump and a sump in the floor. The sump can have a sidewall, a bottom wall with an inlet leading to the wash pump, an inlet leading to the drain pump and a sump conduit connected to the outlet of the wash pump. A filter assembly can be positioned in the sump over the sump conduit and can include a generally vertical filter retainer and an overlying perforate hood, a multiple porosity filter element carried on the filter retainer and a back wash sprayer rotatably mounted on the sump conduit. A spray arm can be rotatably mounted on top of the sump conduit. The wash pump inlet can be positioned inside the filter assembly and the drain pump inlet can be positioned outside the filter assembly.

In another aspect of the invention the floor and sidewalls can have a mounting cavity at one corner for the wash pump and a mounting cavity at another corner for the drain pump.

In another aspect of the invention the spray arm can have S shaped arms and can include a plurality of nozzles configured to spray water in multiple directions.

In another aspect of the invention the drain pump can have a soil management system positioned to comminute soil particles prior to entry into the drain pump after the soil particles leave the sump.

DESCRIPTION OF THE PREFERRED EMBODIMENT

The filter assembly according to the invention can be used in a compact drawer dishwasher configuration. While the invention will be described in the context of drawer dishwasher configuration embodiments, those skilled in the art will understand that the filter assembly according to the invention could be used in a front loading tank configuration as well as in a drawer configuration.

Figure 1:
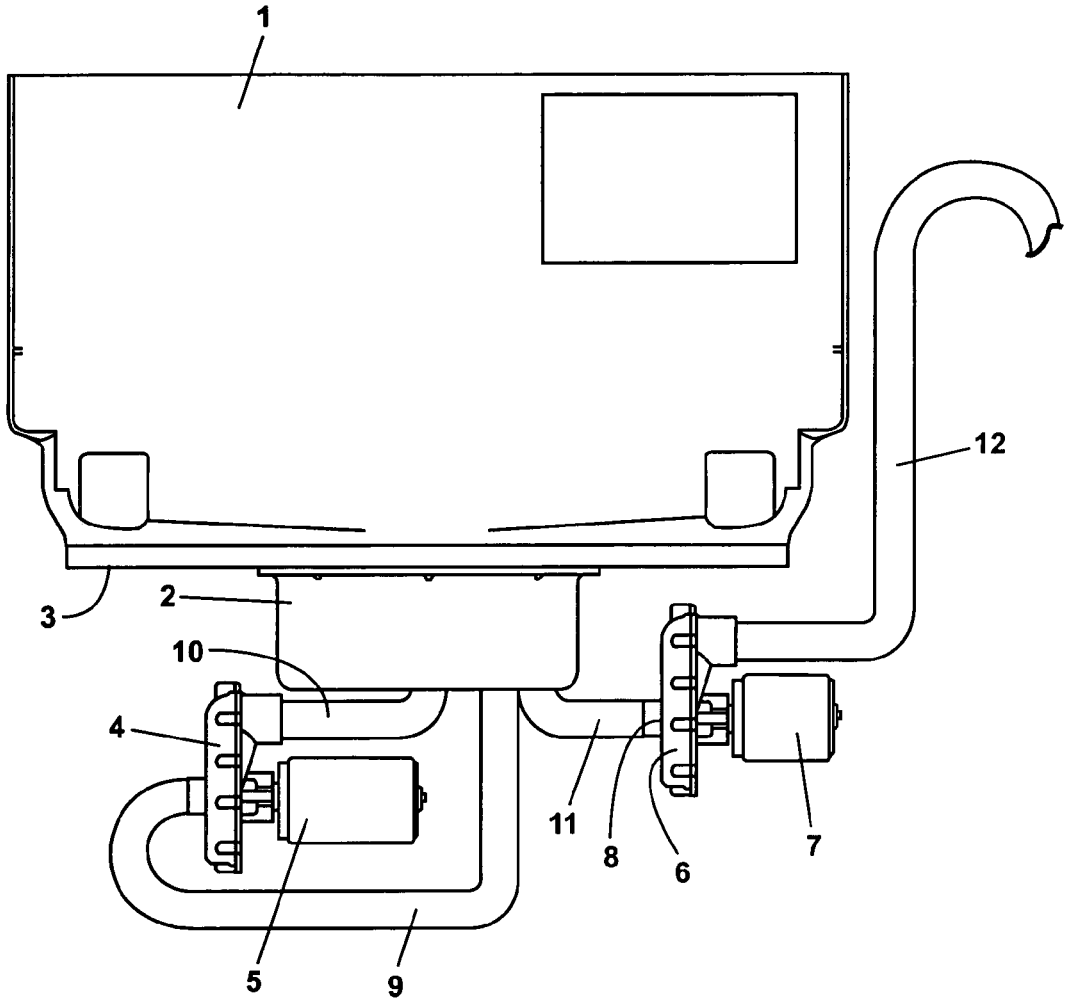
FIG. 1 is a schematic side view of one embodiment of a dishwasher tank having a filter according to the invention.

Turning to FIG. 1, a tank 1 can have a sump 2 positioned on the bottom wall 3 for a drawer configuration dishwasher. A filter assembly according to the invention can be located in the sump 2. A wash pump 4 can have a wash pump motor 5. A drain pump 6 can have a drain pump motor 7. A soil management system 8 can be located in the inlet of drain pump 6. Soil management system 8 will be described in further detail below. Water being recirculated by the wash pump 4 can flow from sump 2 via wash pump inlet conduit 9 and can flow from wash pump 4 back to the sump 2 via wash pump outlet conduit 10. Water being drained from the dishwasher can flow from sump 2 to drain pump 6 via drain pump inlet conduit 11. Drain pump 6 can discharge water to drain via drain line 12 that can connect to the household plumbing system, not shown. While the embodiment of FIG. 1 shows separate wash and drain pumps, those skilled in the art will understand that the wash pump and drain pump can be combined in an assembly that can be driven by a single motor that can be reversible with one pump operable when the motor runs in one direction and the other pump operable when the motor runs in the opposite direction.

Figure 2:
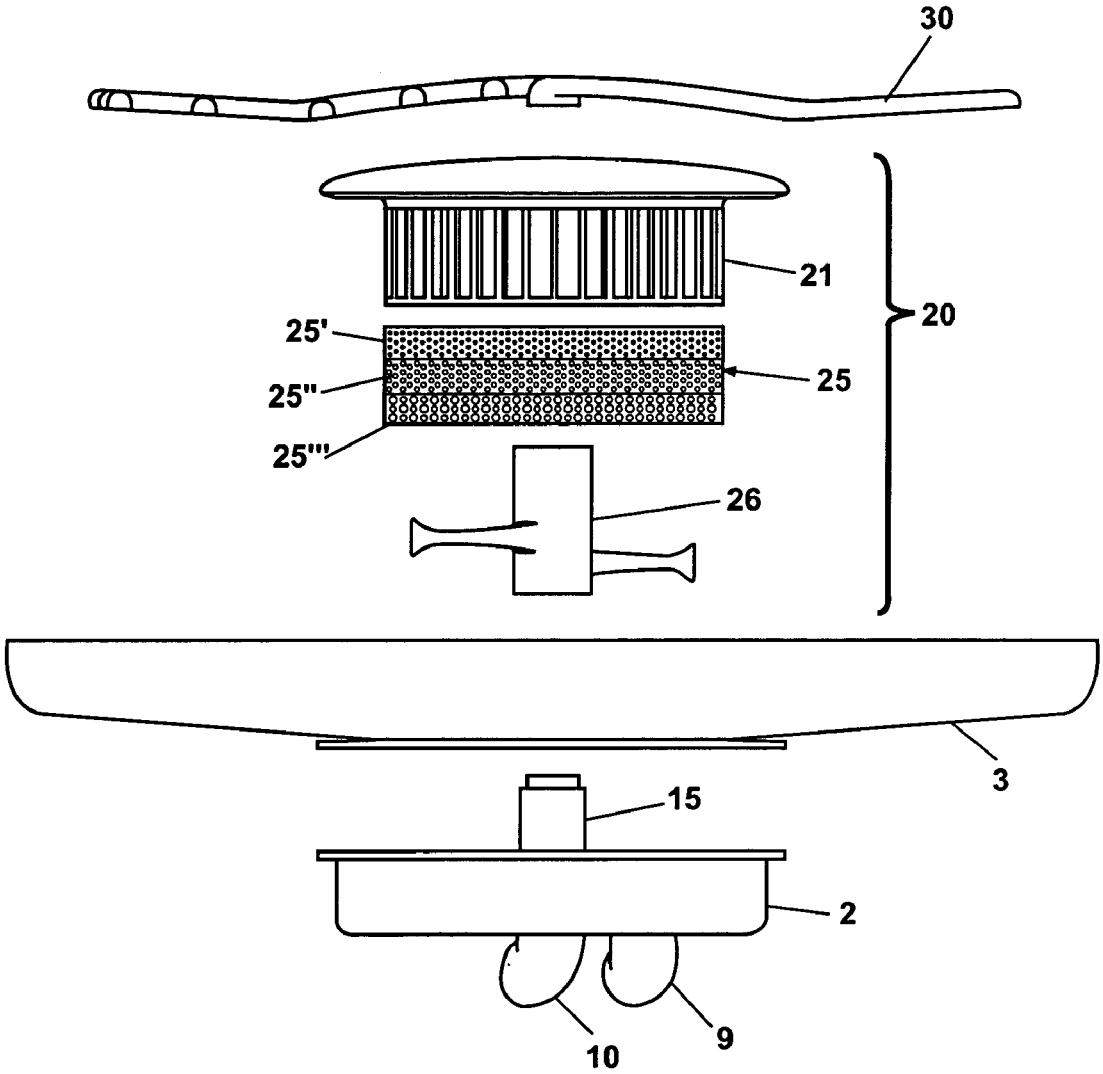
FIG. 2 is an exploded side view of one embodiment of the filter assembly according to the invention.
Figure 3:
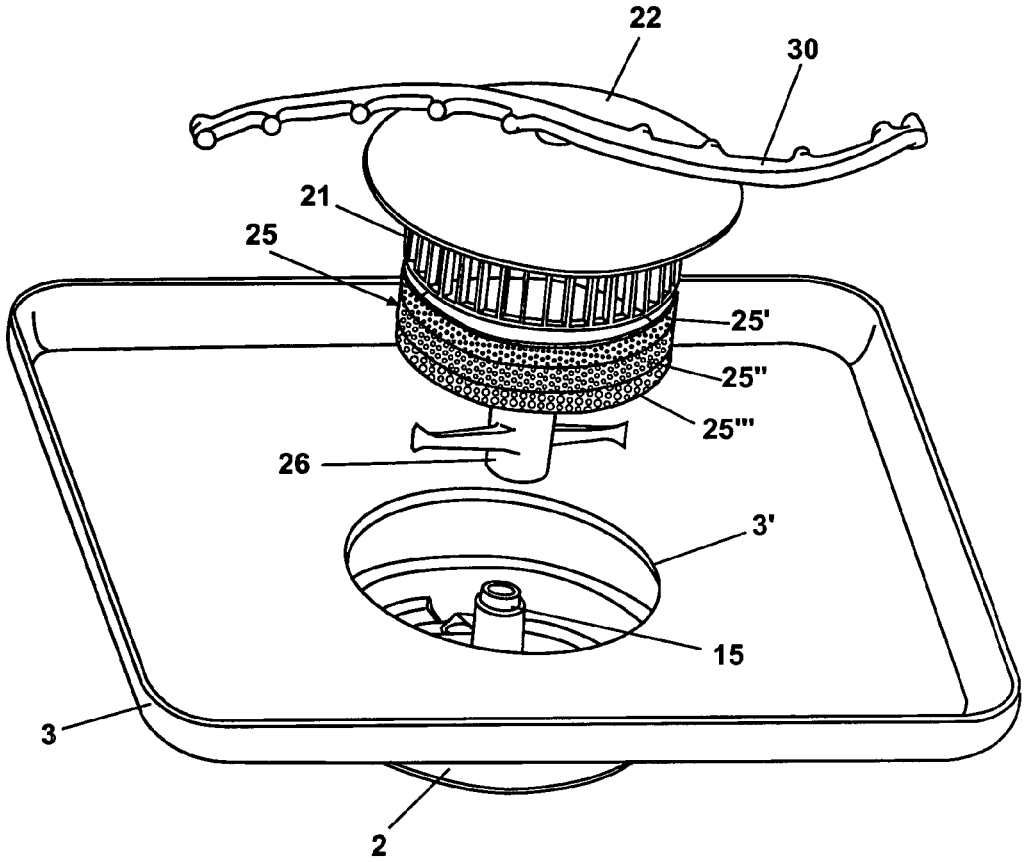
FIG. 3 is an exploded top perspective of the filter assembly as shown in FIG. 2.

Turning to FIG. 2 and FIG. 3, the embodiment of a filter assembly for the dishwasher tank of FIG. 1 can be seen with the side walls removed and the sump and filter assembly exploded to facilitate viewing of the components. Tank bottom 3 can have an opening 3' leading to sump 2. While the embodiment of FIG. 1-FIG. 3 shows sump 2 as a separate element, those skilled in the art will understand that sump 2 can be formed integrally with tank bottom 3 as part of tank 1. When sump 2 is a separate element, suitable fasteners, not shown, bonding, or plastic welding or other well known techniques can employed to attach sump 2 to bottom wall 3. Filter assembly 20 can include a filter retainer 21, an overlying perforate hood 22, a filter element 25 described in greater detail below, and a back wash sprayer 26. Back wash sprayer 26 can be positioned over sump conduit 15 extending upwardly from the bottom wall of sump 2 and fed by wash pump outlet conduit 10. Filter element 25 can be attached to filter retainer 21 by adhesive, heat sealing, sonic welding, or other methods of attaching a foraminous element to a frame as are well known in the art. Filter retainer 21 and perforate hood 22 can be positioned over sump conduit 15. Spray arm 30 can be rotatably mounted on sump conduit 15 above perforate hood 22 by a suitable retainer, not shown.

Figure 4:
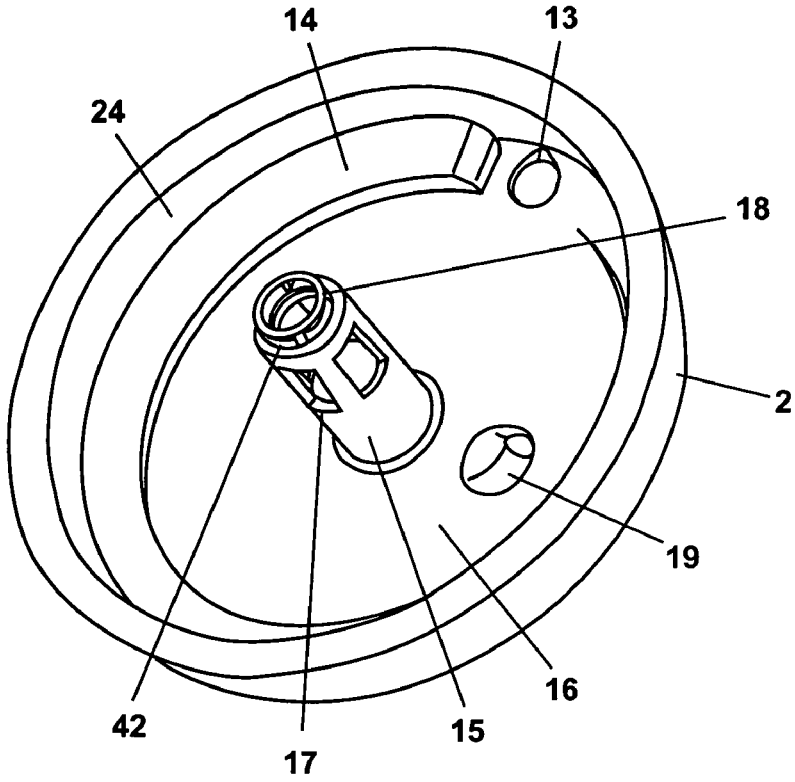
FIG. 4 is a perspective view of one embodiment of a sump for use with the filter assembly according to the invention.

Turning to FIG. 4, the sump 2 can be seen in greater detail. Sump conduit 15 can rise from the center of bottom wall 16. Sump conduit 15 can include one or more back wash openings 17 to feed recirculating wash water to back wash sprayer 26. At the top of sump conduit 15 a suitable bearing surface 18 can be provided to rotatably support spray arm 30 and provide wash water under pressure to the interior of spray arm 30. Bottom wall 16 of the sump 2 can include a wash pump inlet 19 that can be positioned between sump conduit 15 and the perimeter wall 24 of sump 2 so that the wash pump inlet 19 can be inside the filter element 25 when the filter assembly 20 is assembled in sump 2. Bottom wall 16 can also include a drain pump inlet 13 that can be positioned adjacent the perimeter wall 24 of sump 2. Bottom wall 16 can also include a ramp surface 14 adjacent the perimeter wall 24. Ramp 14 begins at the level of drain pump inlet 13 at one edge of drain pump inlet 13 and rises to a high point at the opposite edge of drain pump inlet 13. Ramp 14 can have a radial dimension sufficient to substantially fill annular space 23 between filter element 25 and the perimeter wall 24 so that ramp 14 can form a sloped bottom wall for the space 23 between filter element 25 and perimeter wall 24. Those skilled in the art will understand that ramp 14 can be arranged in other configurations for use with the filter system according to the invention including, but not limited to, a ramp 14 with the high point opposite drain pump inlet 13 so that soil particles and wash water can flow in opposite direction in annular space 23 to drain pump inlet 13.

Figure 5:
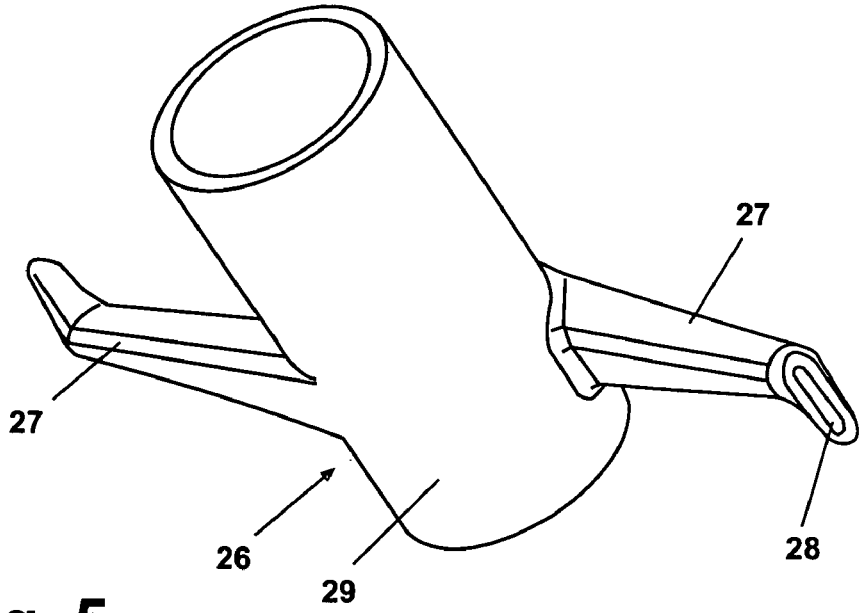
FIG. 5 is a perspective view of a back wash sprayer as shown in FIG. 2 and FIG. 3.

Turning to FIG. 5, back wash sprayer 26 can be seen in greater detail. Back wash sprayer 26 can include hollow two arms 27 that can lead from the interior of back wash sprayer 26 to nozzle 28 formed in the distal ends of arms 27. As shown in FIG. 5, arms 27 can be positioned on hub 29 that can be arranged to rotatably support back wash sprayer 26 on sump conduit 15. Back wash sprayer 26 can include suitable seals or sealing surfaces, not shown, to rotatably seal hub 29 to sump conduit 15 so that recirculating wash water can pass through back wash openings 17 into hub 29 and thence into hollow arms 27. Nozzle 28 in the distal ends of arms 27 can be elongated and sized to provide a suitable spray pattern to back wash filter element 25. As shown in FIG. 2 and FIG. 5, arms 27 can be vertically spaced to provide a suitable spray pattern to substantially cover the vertical extent of filter element 25. Also as shown in FIG. 5, arms 27 can be offset from a plane passing through the axis of hub 29 to provide a moment arm force to rotate back wash sprayer 26 as water flows through back wash sprayer 26.

Figure 6:
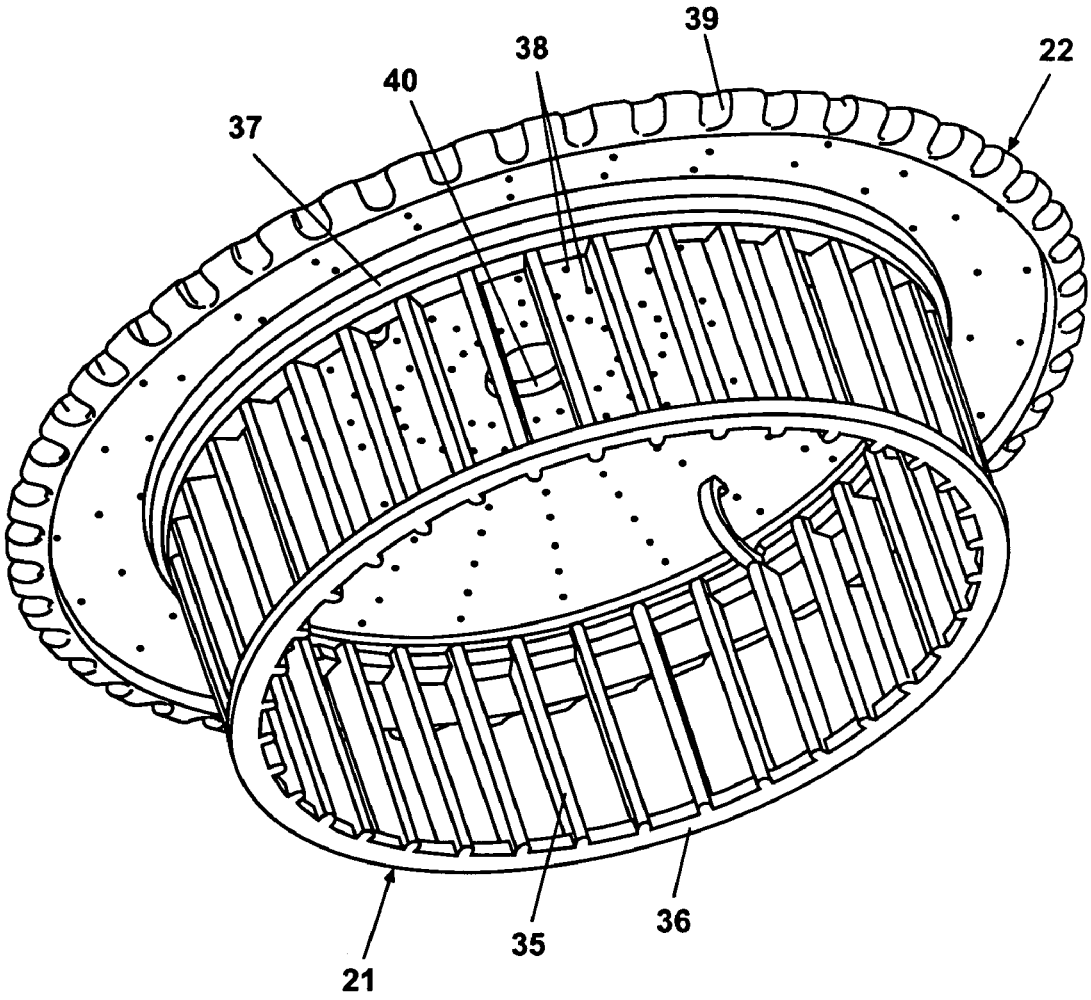
FIG. 6 is a bottom perspective view of one embodiment of a filter retainer and perforate hood according to the invention.

Turning to FIG. 6, filter retainer 21 and perforate hood 22 embodiment can be seen in greater detail removed from sump 2. Perforate hood 22 can be formed integrally with filter retainer 21, or filter retainer 21 can be a separate element. Filter retainer 21 can be a generally cylindrical cage and can include a plurality of vertical bars 35 extending from bottom ring 36 to upper ring 37. While the filter retainer 21 shown in the embodiment of FIG. 6 includes 36 vertical bars 35 those skilled in the art will understand that fewer or more vertical bars can be provided. The number of vertical bars 35 to be provided can be determined by the kind of filter element 25 that will be supported on filter retainer 21. When filter element 25 is formed of relatively rigid sheet material such as stainless steel fewer vertical bars 35 can be provided. When filter element 25 is formed of relatively pliable sheet material such as woven or etched foraminous plastic material more vertical bars can be provided to support the filter element 25.

Filter retainer 21 and perforate hood 22 can be formed of stainless steel, molded plastic material or other material suitable for use in a dishwasher as will be readily understood by those skilled in the art. Filter retainer 21 including bottom ring 36, vertical bars 35 and top ring 37 can be formed in one piece of a suitable plastic material as is well known in the art. Perforate hood 22 can similarly be formed of plastic material, or as those skilled in the art will understand, the perforate hood and filter retainer can be formed as a single piece. Perforate hood 22 and filter element 21 can be separate elements held together in sump 2 by a retainer, not shown, or by spray arm 30. When perforate hood 22 and filter retainer 21 are separate elements they can be provided with suitable retainers or latches so that the elements can be snapped or locked together as are well known in the art. Alternately, filter retainer 21 and perforate hood 22 can be attached by adhesive, heat sealing or sonic welding, if formed of plastic material, and by welding or mechanical fasteners, if formed of metal, again all as well known in the art.

Perforate hood 22 can include a plurality of openings 38 that can allow recirculating wash water to flow into sump 2. Openings 38 can be sized to filter food particles from the wash water to help prevent re-deposition of the food particles on dishes being washed. The perimeter of perforate hood 22 can include a plurality of notches 39 around all or part of the perimeter of perforate hood 22. When the filter assembly is installed in sump 2 perforate hood 22 can be closely spaced from tank bottom 3 and can provide a flow path between perforate hood 22 and tank bottom 3 for wash water having soil particles mixed with the wash water. Notches 39 can provide a larger gap to allow larger food particles to pass into the sump outside filter element 25. Notches 39 can be dimensioned to prevent large soil particles such as pits and seeds from flowing into sump 2 that could damage or block drain pump 6 or damage the soil management system 8. Filter retainer 21 and perforate hood 22 can be assembled over sump conduit 15. Perforate hood 22 can include sump conduit opening 40 that can be located in perforate hood 22 to align with sump conduit 15. Sump conduit 15 can extend through opening 40 to rotatably support spray arm 30 above perforate hood 22.

Returning to FIG. 2 and FIG. 3, filter element 25 can be formed of stainless steel or plastic material that can be woven to form a mesh, or can be etched to form a mesh, each well known to those skilled in the art. Filter element 25 can have openings of different sizes to form a multiple porosity filter. In the embodiment of FIG. 2 and FIG. 3, filter element 25 can have three bands of openings of differing sizes. Top band 25' can include fine porosity openings on the order of 100 microns (μm). Middle band 25" can include medium porosity openings on the order of 250 μm. Bottom band 25''' can include coarse porosity openings on the order of 1000 μm. The fine, medium and coarse porosity openings in the filter element embodiments described in above can be larger or smaller than mentioned above. For example, the fine porosity openings can range from 75 to 150 μm, the medium porosity openings can range from 175 to 350 μm, and coarse porosity openings can range from 800 to 1200 μm.

Applicants have found that, for a typical user, soil particles suspended in wash water tend to gather in sump 2 in the space 23 between filter element 25 and sump perimeter wall 24 according to size. Thus, the smallest particles tend to be suspended toward the top of space 23 and the largest particles tend to settle toward the bottom of space 23. Thus, arranging filter element 25 with fine porosity band 25' at the top and coarse porosity band 25''' at the bottom of the filter element places filter porosity bands adjacent the likely position of soil particles the respective bands of openings are designed to filter from wash water flowing through filter element 25. When wash pump 4 is de-activated and drain pump 6 is activated soil particles in space 23 are drawn by drain pump 6 to drain pump inlet 13 at the low point of ramp 14. Openings 38 in perforate hood 22 can be on the order of 1000 μm, or about the same size as the porosity of the openings in the coarse band 25''' of filter element 25. Openings 38 in perforate hood 22 can range from 800 to 1200 μm. Those skilled in the art will understand that openings 38 and can be sized to assure an adequate flow rate to the wash pump inlet 19 while being sized small enough to protect water passageways and nozzles from clogging and minimizing redeposition of food particles on ware being washed.

Another filter element embodiment 25*a*, not shown, can have openings that vary in size in a continuous manner from top to bottom. Filter element 25*a* can have openings that vary in size from fine porosity openings on the order of 100 μm adjacent the top of the filter element to coarse porosity openings on the order of 1000 μm adjacent the bottom of filter element 25*a*. Another filter element embodiment 25*b*, not shown, can have medium porosity openings on the order of 250 μm in the top band and fine porosity openings on the order of 100 μm in the middle band. Another filter element embodiment 25*c*, not shown, can have an imperforate bottom band and can have top and middle bands like the filter element embodiments 25*a* or 25*b*. While the embodiment of filter element 25 in FIG. 2 and FIG. 3 is described as having three bands of differing porosity openings, those skilled in the art will understand that the invention contemplates the use of two bands or more than three bands of differing porosity openings in filter element 25. Likewise, filter element 25 could comprise uniform or randomly sized openings in the range of opening sizes described above in bands 25', 25" and 25'''. Within the scope of the invention alternate filter elements including, but not limited to filter elements 25, 25*a*, 25*b* and 25*c*, can be provided to the user as accessories. Providing multiple filter elements to a user can permit easy changing of the filter to allow users to select a filter configuration that matches their usage patterns and to accommodate different types of food particles on dishes. Food particles on dishes can vary from user to user based on the type of foods typically prepared and consumed and on the user's habits in preparing dishes for washing.

Figure 12:
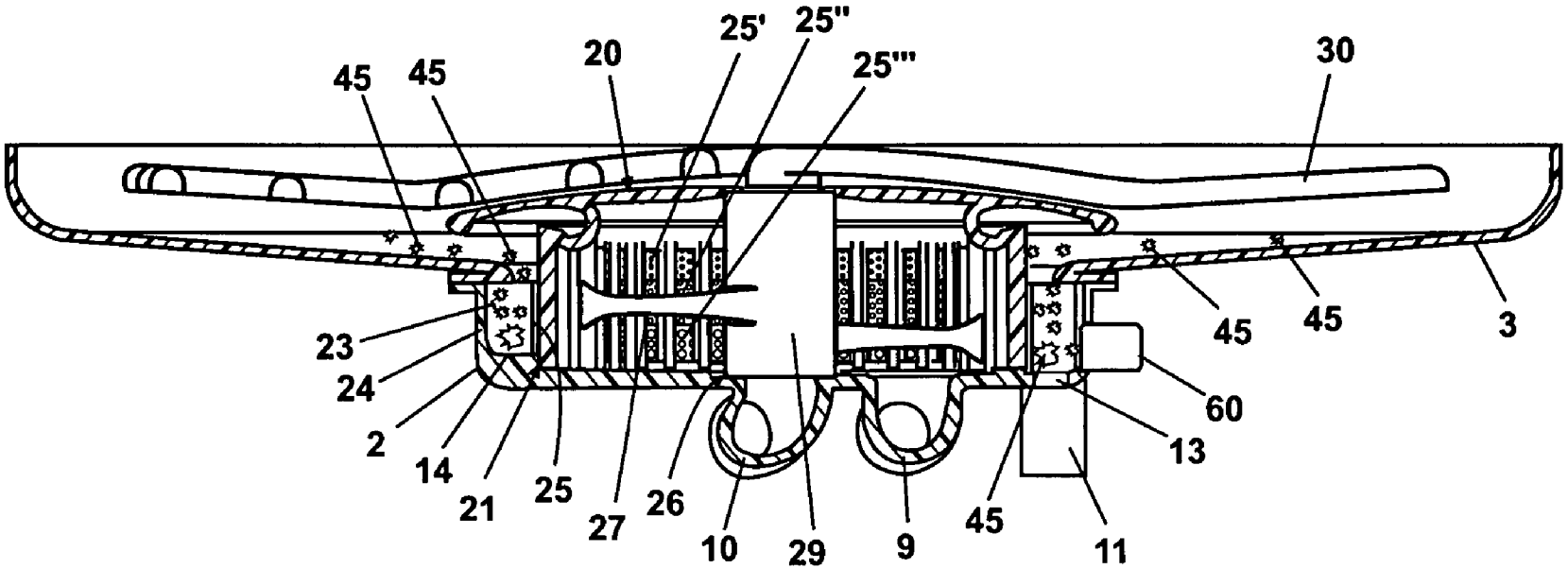
FIG. 12 is partial sectional view of the dishwasher tank of FIG. 1 showing the filter assembly installed in the sump.

Turning to FIG. 12, a partial section view through sump 2 shows the relationship of the sump 2, filter assembly 20 and tank bottom 3 in greater detail. Sump 2 is positioned in tank bottom 3 and can be arranged to hold filter assembly 20. Drain pump inlet opening 13 can be seen in the bottom of space 23 between filter 25 and sump perimeter wall 24. As described above, ramp 14 can begin and end on opposite sides of drain pump inlet opening 13 to facilitate draining of water and food particles to drain during drain portions of a dishwashing cycle. As noted above, food particles 45 and other undisolved soil borne in wash water being recirculated by wash pump 4 too large to pass through openings 38 in perforate hood 22 can be flushed into space 23 by wash water recirculated by spray arm 30. Food particles 45 too large to pass through filter element openings 25', 25" or 25''' remain in space 23 until drain pump 6 is operated in a drain cycle. Thus, food particles 45 can remain trapped in space 23 without recirculation or being broken into smaller pieces by flowing through a pump impeller or food chopper. A sensor 60 can be positioned on sump sidewall 24 to monitor the condition of wash water passing through space 23 between filter element 25 and sump sidewall 24. The operation of sensor 60 will be described in greater detail below.

Referring again to FIG. 12, back wash sprayer 26 arms 27 can be seen extending from hub 29 towards filter retainer 21. In the embodiment of FIG. 12 arms 27 can extend from hub 29 to adjacent the inside perimeter of filter retainer 21 and can position nozzles 28 closely adjacent the inside perimeter of filter retainer 21 and accordingly filter element 25. Placing nozzles 28 adjacent the inside perimeter of filter retainer 21 can facilitate flushing of food particles 45 off filter element 25. Filter element 25 can be seen in FIG. 12 with fine 25', medium 25" and coarse 25''' bands of filter openings as described above. Also as mentioned above, larger sized food particles 45 tend to settle to the bottom of annular space 23. Those skilled in the art will readily understand that a heater 75, not shown, can be provided in sump 2 or in tank bottom 3 to heat wash water to increase or maintain wash/rinse water temperature in tank 1 during wash and/or rinse cycles as is well known in the art.

Figure 7:
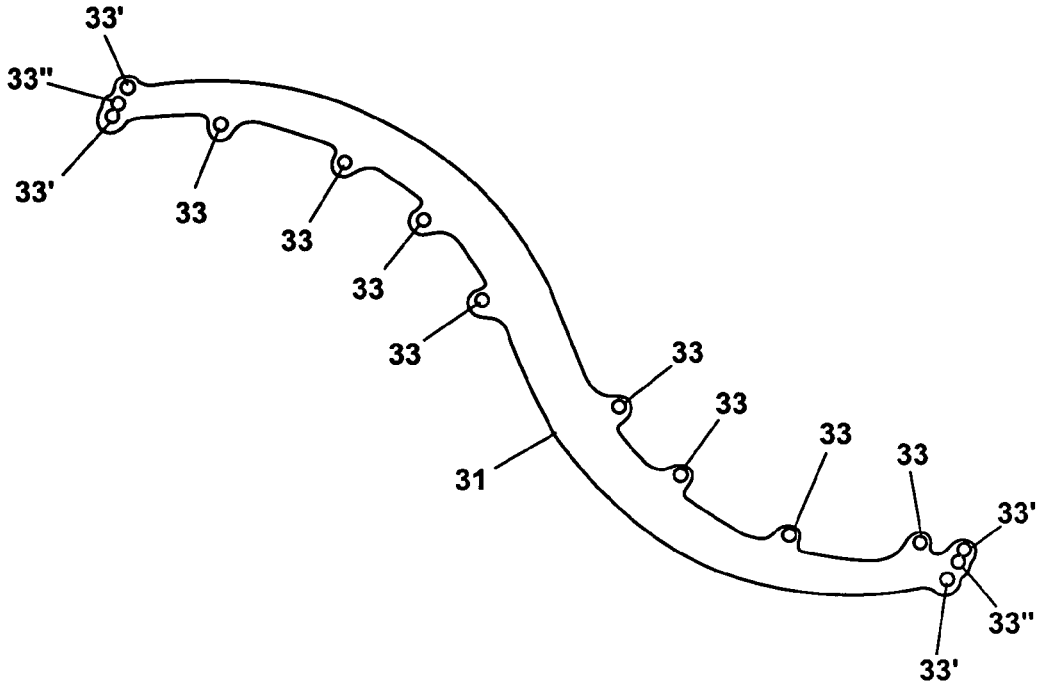
FIG. 7 is a top view of one embodiment of a spray arm as shown in FIG. 2 and FIG. 3.
Figure 8:
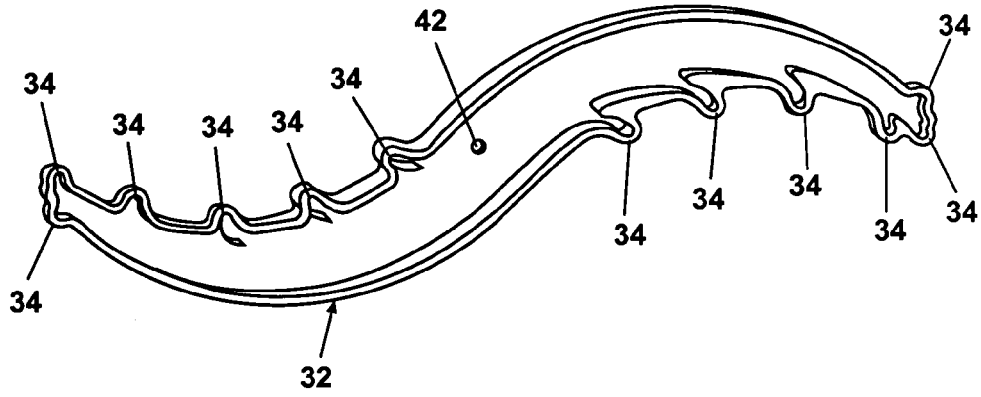
FIG. 8 is a top view of the bottom member of the spray arm of FIG. 7 with the top member removed.
Figure 9:
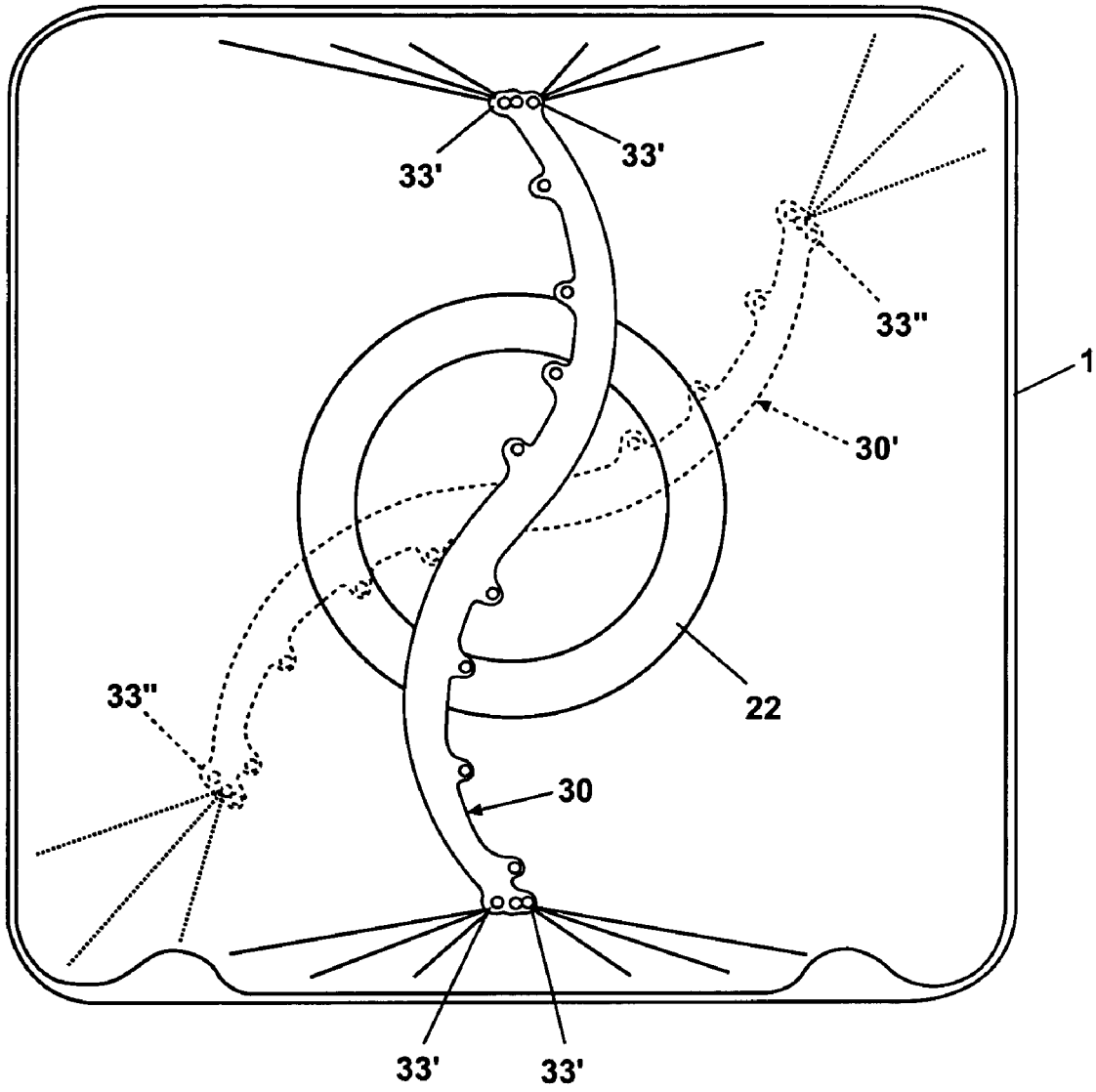
FIG. 9 is a schematic view showing spray patterns of the spray arm shown in FIG. 7.

Turning to FIG. 7-FIG. 9, one embodiment of a spray arm 30 that can be used with the filter system according to the invention can be seen in greater detail. Spray arm 30 can include a top member 31 and a bottom member 32 and can have a generally S-shape. Top member 31 can include a plurality of spray arm nozzle openings 33 that can be elongated in shape. Nozzle openings 33, 33' and 33" can be oriented in different directions to provide an asymmetric spray pattern. The asymmetric spray pattern can be seen by referring to FIG. 9 which shows a spray arm 30 in one position with the spray pattern from nozzles 33' and phantom spray arm 30' in another position with the spray pattern of nozzles 33" to show the effect of asymmetric spray nozzles. The spray pattern of nozzles 33' can be directed in opposite directions generally parallel to the side walls of tank 1. The spray pattern of nozzles 33" can be directed generally perpendicular to the side walls of tank 1. Those skilled in the art will understand that, in operation, wash liquid can flow from all nozzles 33, 33' and 33". As shown in FIG. 8, bottom member 32 can cooperate with top member 31 to form a hollow spray arm. Bottom member 32 can include a plurality of sub channels 34 leading from the central portion of lower member 32 to the periphery of spray arm 30 that can terminate at spray arm nozzles 33, 33' and 33". Upper member 31 can be generally flat or can include complementary sub channels, not shown, leading from the central portion of upper member 31 and terminating at spray arm nozzles 33, 33' and 33". Sub channels 34 can improve flow of wash water to each of the spray arm nozzles 33, 33' and 33". Lower member 32 can include a center opening 42 that can be arranged to accept the bearing surface 18 of sump conduit 15. Those skilled in the art will understand that bearing surface 18, lower member 32 or upper member 31 can be provided with a suitable retainer, not shown to hold spray arm 30 in place on top of sump conduit 15. The perimeter of sump conduit 15 below bearing surface 18 can include a plurality of spray arm openings 41 to allow wash water pumped through sump conduit 15 to pass into spray arm 30. Those skilled in the art will understand that other known spray arm configurations can be used with the filter system according to the invention.

Figure 10:
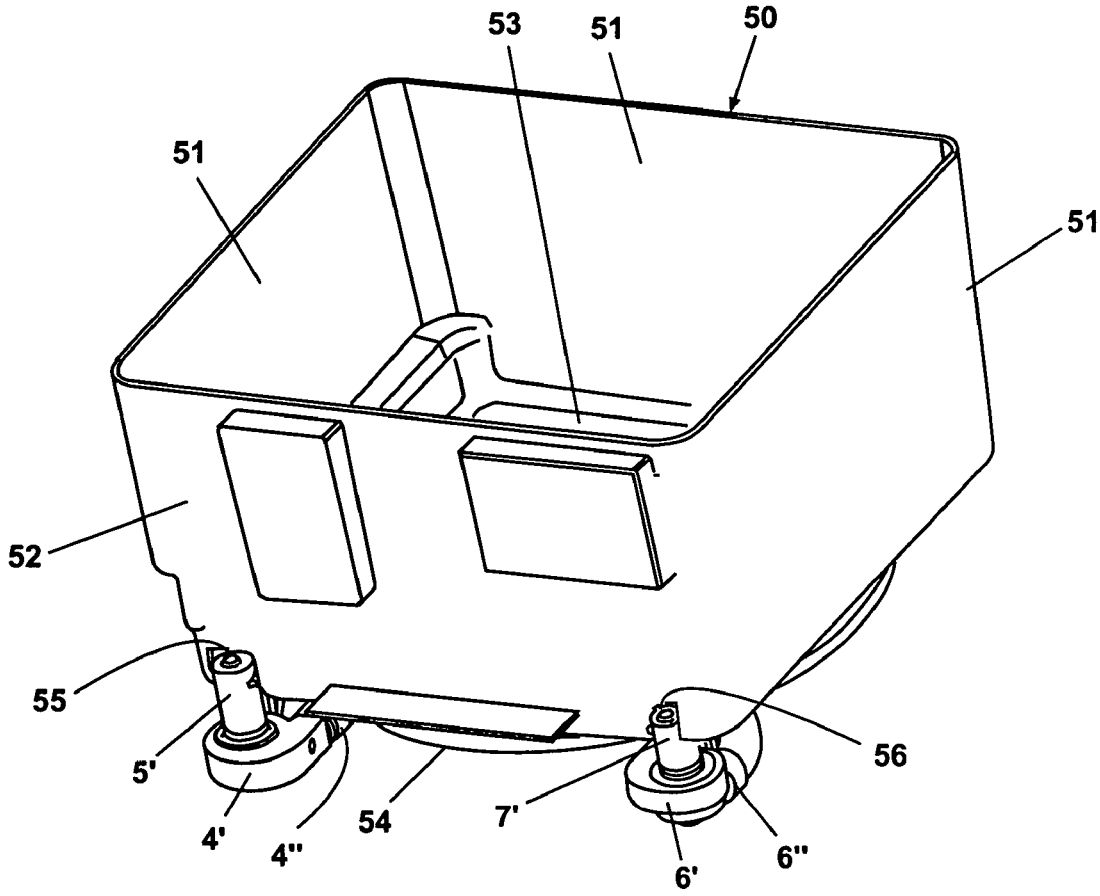
FIG. 10 is a rear perspective view of another embodiment of a dishwasher having a filter according to the invention.
Figure 11:
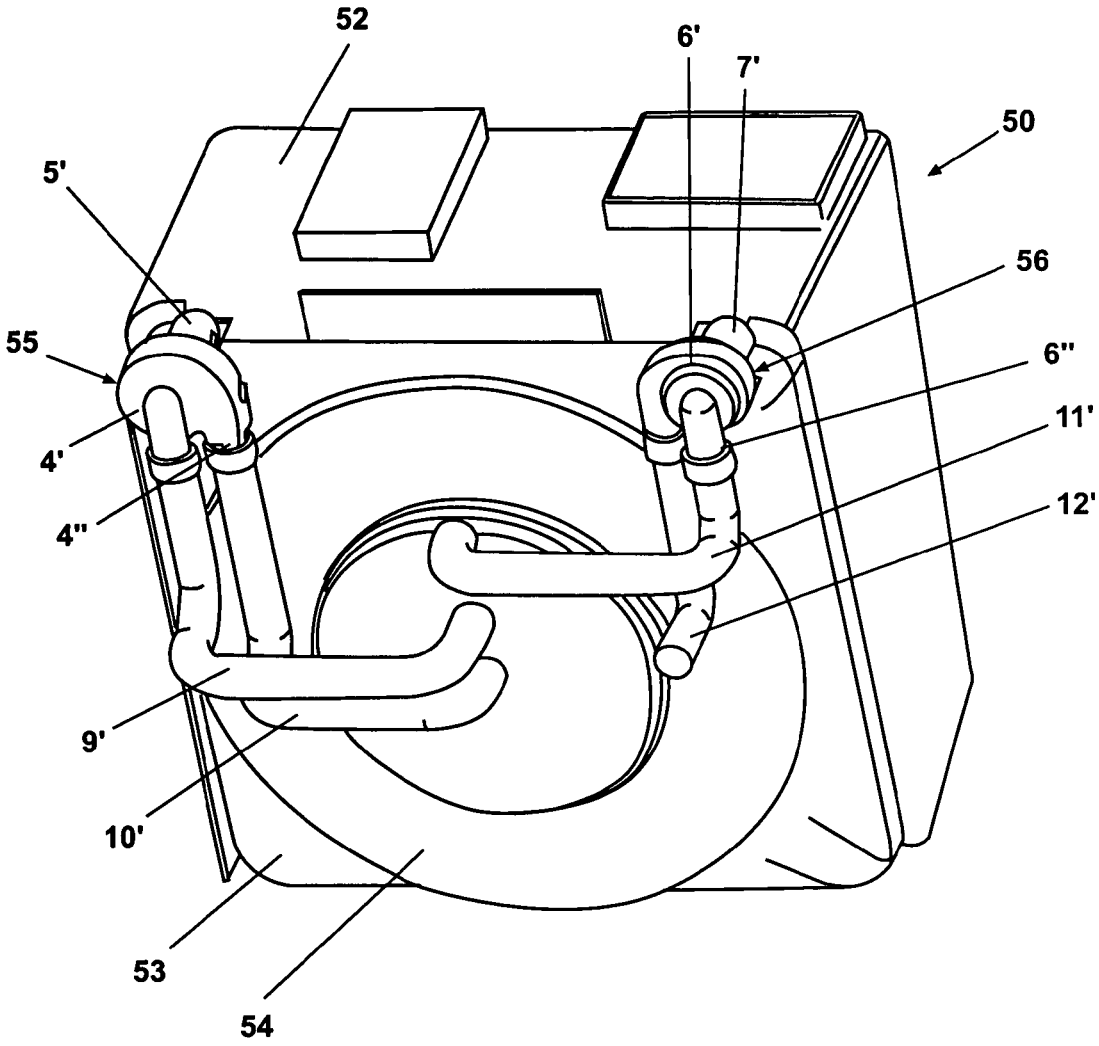
FIG. 11 is a bottom perspective view of the dishwasher tank of FIG. 10.

Turning to FIG. 10 and FIG. 11 two other embodiments of a dishwasher tank can be seen. Tank 50 can include a plurality of side walls 51 and 52 and a bottom wall 53. One of the side walls 52 can include a wash pump cavity 55 and a drain pump cavity 56. Bottom wall 53 can include an integrally molded sump 54. Wash pump cavity 55 can be arranged to provide a space for wash pump 4' and wash pump motor 5' to be at least partially recessed into the side wall 51. Similarly, drain pump cavity 56 can be arranged to provide a space for drain pump 6' and drain pump motor 7' to be at least partially recessed into side wall 52. In the embodiment of FIG. 10, tank 50 can include conduits integrally formed with tank 50 or assembled to tank 50 to connect wash pump 4' and drain pump 6' to respective inlets and outlets. Self sealing grommets 4" and 6" can be provided to seal the respective pumps to the inlet and outlet conduits thus making pumps 4' and 6' plug in pumps. Self sealing grommets 4" and 6" can be "T" shaped with a hollow flange and a hollow cylindrical body portion and formed of elastomeric material. Grommets 4" and 6" can include sealing surfaces on the inside and outside surfaces of cylindrical portion, not shown. The cylindrical portion of the grommets 4" and 6" can be inserted into the wash pump and drain conduit openings in the bottom of tank 50 and the wash pump 4' and drain pump 6' inlets and outlets can be inserted into the grommets 4" and 6". Thus grommets 4" and 6" can seal the wash pump 4' and drain pump 6' to the tank 50. The sealing surfaces on the inside and outside surfaces of the cylindrical portion of the grommets 4" and 6" can assure a water tight seal of the wash pump 4' and drain pump 6' to tank 50. The elastomeric material of grommets 4" and 6" can also provide sound and vibration isolation between the wash pump 4', drain pump 6' and wash tank 50. In the embodiment of FIG. 11, wash pump inlet conduit 9' and wash pump outlet conduit 10' can be provided to connect wash pump 4' to sump 54. Similarly, drain pump inlet conduit 11' and drain 12' can be provided to connect drain pump 6' to sump 54 and the household plumbing system, not shown. Those skilled in the art will understand that self sealing grommets, not shown, can be provided to facilitate connection of wash pump 4' and drain pump 6' to conduits 9', 10', 11' and 12' if desired. An advantage of the tank configuration of FIG. 10 and FIG. 11 can be a reduced overall height for the dishwasher tank and associated components including the wash and drain pumps and conduits connecting the pumps to the sump.

Figure 13:
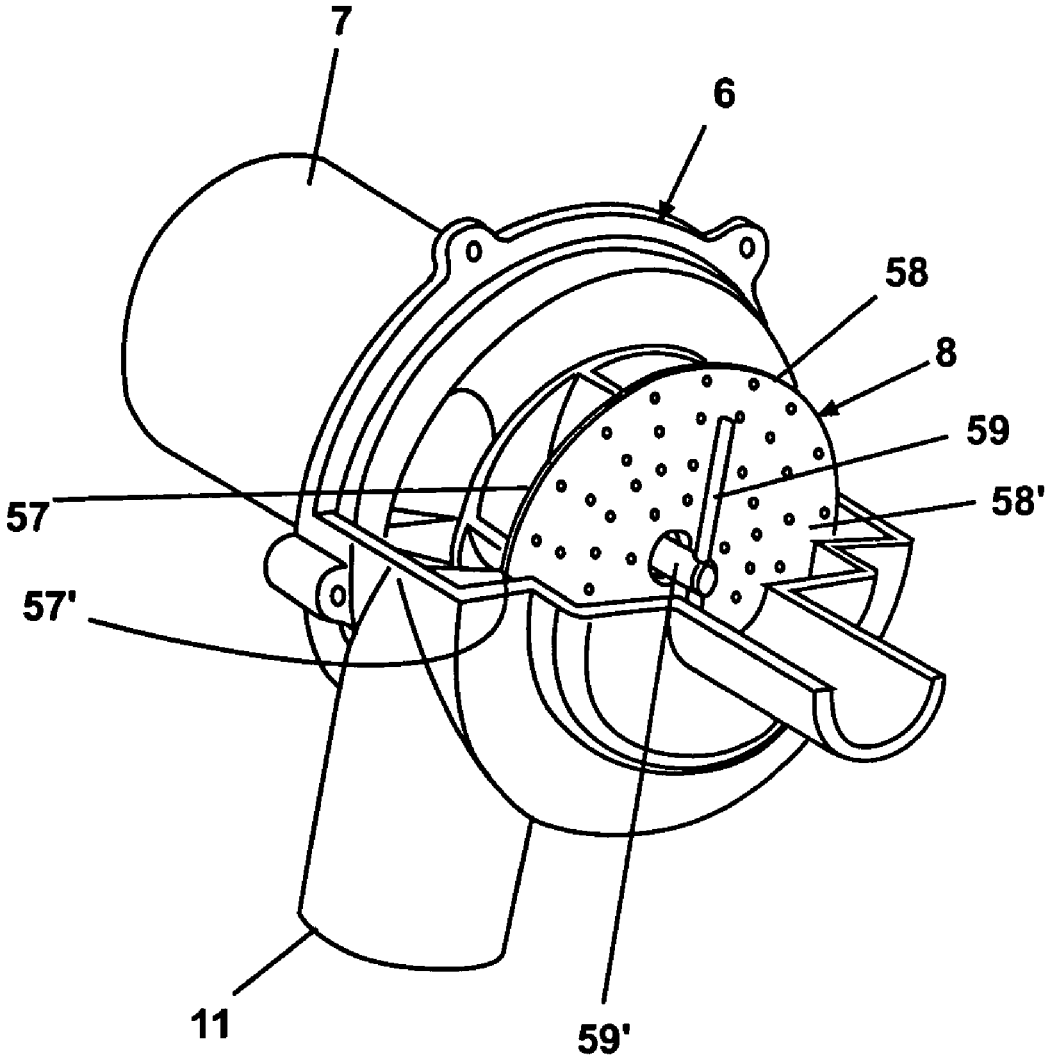
FIG. 13 is a perspective view of the drain pump partially broken away showing the soil size management system.
Figure 14:
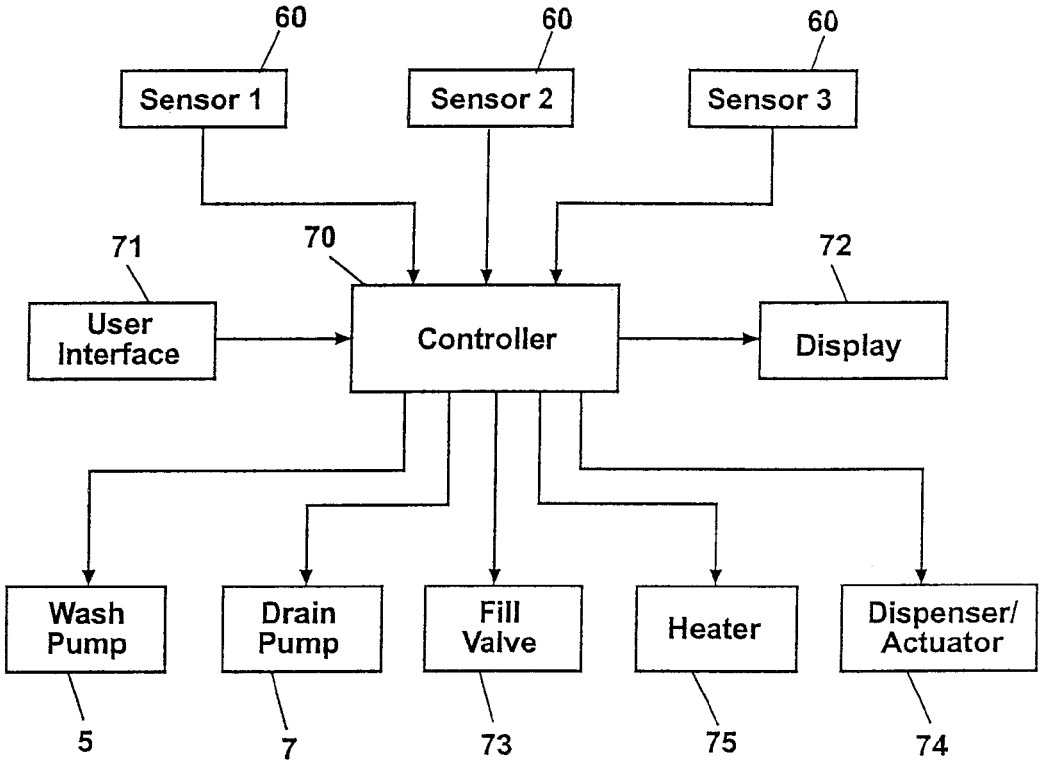
FIG. 14 is schematic drawing showing a control for a dishwasher according to the invention.

Turning to FIG. 13, the soil management system 8 can be seen in greater detail. Drain pump 6 is shown with the pump housing partially broken away showing drain pump impeller 57. A slicing plate 58 can be positioned over drain pump impeller 57 and held in position by a suitable recess 57' in the drain pump housing. Slicing plate 58 can include a plurality of openings 58' sized to comminute food particles to a small size to assure that the food particles will not interfere with operation of drain pump 6. Slicing plate 58 can be formed of stainless steel. A chopping member 59 can be positioned adjacent slicing plate 58. Chopping member 59 can a metal rod such as stainless steel or can be a flexible member formed of a strong plastic material such as nylon. Chopping member 59 can be attached to drive shaft 59' to rotate with drive shaft 59' when drain pump 6 is operating. In the embodiment of FIG. 13 chopping member 59 can be held in an opening in drive shaft 59'. Wash water being drained from the dishwasher can flow through drain pump inlet conduit 11 into drain pump inlet 11'. Chopping member 59 rotating with drive shaft 59' can impact food particles carried by wash water to break the food particles into small pieces that can pass through openings 58' in slicing plate 58. Food particles too large to pass through openings 58' can be held in the chamber between drain pump inlet 11' and slicing plate 58 until chopping member 59 has broken the food particles into small enough pieces to pass through openings 58'.

Returning to FIG. 12, a sensor 60 can be provided in sump 2 to sense when sufficient food particles have built up in the annular space 23 between sump perimeter wall 24 and filter element 25 to reduce water flow to wash pump 4 to the point where flow rates and washing performance could degrade. Sensor 60 can be any well known sensor for detecting material build up and can include a turbidity or other optical sensor that responds to the presence of sufficient soil particles, a pressure sensor that responds to a rise in water level in the annular space 23 between sump perimeter wall 24 and filter element 25, or other well known sensors. When sensor 60 detects a sufficient buildup of material on filter element 25, controller 70 can cause drain pump 6 to operate to pump water and accumulated soil particles to drain 12. Controller 70 can then cause fill valve 73 to refill tank 1 to the appropriate level and resume operation of the wash or rinse cycle interrupted to flush soil particles to drain. Those skilled in the art will understand that in lieu of a sensor 60 control 70 can be provided with a current sensing control such as are well known in the art to sense changes in current flow to wash pump motor 5 due to a build up of soil particles in annular space 23.

When sensor 60 is a pressure sensor, sensor 60 can also detect when a back wash nozzle 28 passes by the sensor 60 as the pressure in space 23 can momentarily rise. When sensor 60 is a pressure sensor, sensor 60 can also be utilized to detect that spray arm 30 is rotating. Sensor 60 can detect spray arm 30 rotation if spray arm 30 is provided with a spray arm nozzle directed down into space 23. Thus, as spray arm 30 rotates past sensor 60 a momentary increase in pressure can be detected. As food particles accumulate in space 23 the pressure rise due to back wash nozzle 28 passing by sensor 60 can be less than when food particles are not present. Thus, the output of pressure sensor 60 can provide information about the quantity of food particles accumulated in space 23, and also can provide information about the operation of back wash nozzle 28 and can provide information about spray arm 30 operation. For example, if periodic signals indicative of a back wash nozzle 28 passing by sensor 60 cease, controller 70 for the dishwasher could cause display 72 to advise the user to check the filter. Likewise, absence of signals indicative of spray arm 30 operation could cause controller 70 to cause display 72 to advise the user to check the spray arm.

A user can initiate a dishwashing cycle by selecting a cycle on user interface 71 and pressing a start button, not shown. Controller 70 can cause a fill valve 73 to admit water to fill tank 1 to the appropriate level. In operation, during wash and rinse cycles wash pump motor 5 can be activated by controller 70 causing wash water to be drawn out of the sump 2 through wash pump inlet 19 through filter element 25. Controller 70 can also operate dispenser 74 to add detergent and/or rinse additive material at the appropriate time in the cycle. As mentioned above, filter retainer 21 and filter element 25 substantially close of the space between perforate hood 22 and bottom wall 16 of sump 2. Thus, substantially all wash water returned to wash pump 4 must pass either through filter element 25 or perforate hood 22. Spray arm 30 can include one or more nozzles, not shown, that can be arranged to flush soil particles off perforate hood 22 and into space 23 between filter element 25 and sump perimeter wall 24. As mentioned above, back wash sprayer 26 receives wash water during wash cycles and can be arranged to spray water against the inside surface of filter element 25. Thus, during wash cycles back wash sprayer 26 can continually back wash soil particles off of filter element 25 to reduce the chance of filter element 25 clogging with soil particles.

During drain cycles, drain pump motor 7 can be activated by controller 70 to draw water and soil particles from space 23 through drain pump inlet 13 in bottom wall 16 of sump 2. As mentioned above, ramp 14 forms a ramped bottom wall to space 23 with drain pump inlet 13 located at the low point. Thus, soil particles in space 23 can be flushed to the drain pump inlet 13 during drain cycles. During drain cycles wash pump 4 can be de-activated, although those skilled in the art will understand that the wash pump can be allowed to operate during the initial portion of a drain cycle to facilitate washing of food particles out of tank 1 and off of filter element 25. As described above, soil size management system 8 can reduce the size of soil particles prior entry into drain pump 6. An advantage of routing wash water through the soil size management system 8 on the way to the drain pump is to avoid breaking soil particles into fine pieces that can pass through the filter element 25 and/or perforate hood 22 into wash pump 4 until the food particles are entering drain pump 6. Soil particles that pass into wash pump 4 can be re-deposited on dishes being washed reducing satisfaction with the performance of the dishwasher.

While the invention has been specifically described in connection with certain specific embodiments thereof, it is to be understood that this is by way of illustration and not of limitation, and the scope of the appended claims should be construed as broadly as the prior art will permit.

We claim:

1. A filter system for a dishwasher having a floor, a wash pump and a drain pump, the filter system comprising:

a sump in the floor having a sidewall and a bottom wall having an inlet leading to the wash pump and an inlet leading to the drain pump;

a filter assembly positioned in the sump including:

a generally vertical filter retainer and an overlying perforate hood;

a multiple porosity filter element carried on the filter retainer; and a back wash sprayer connected to the wash pump and rotatably mounted inside the filter retainer and having at least one nozzle directed toward the filter element; and a dishwasher control, and a pressure sensor positioned on the sidewall of the sump to detect accumulation of soil particles on the filter element and connected to the dishwasher control and arranged to activate the drain pump to remove soil particles from the sump when a predetermined accumulation of soil particles is detected, the sensor being arranged to detect that the back wash sprayer is rotating and the dishwasher control is arranged to provide a check filter signal to the user when the sensor fails to detect back wash sprayer rotation;

wherein the inlet leading to the wash pump is positioned inside the filter assembly and the inlet leading to the drain pump is positioned outside the filter assembly.

2. A filter system for a dishwasher having a floor, a wash pump and a drain pump comprising:

a sump in the floor having a sidewall and a bottom wall having an inlet leading to the wash pump and an inlet leading to the drain pump;

a filter assembly positioned in the sump including:

a generally vertical filter retainer and an overlying perforate hood positioned adjacent the filter retainer;

a multiple porosity filter element carried on at least a portion of an outer surface of the filter retainer; and a back wash sprayer connected to the wash pump and rotatably mounted inside the filter retainer and having at least one nozzle directed toward the filter element, wherein the inlet leading to the wash pump is positioned inside the filter assembly and the inlet leading to the drain pump is positioned outside the filter assembly;

a dishwasher control, and a sensor positioned on the sidewall of the sump to detect accumulation of soil particles on the filter element and connected to the dishwasher control and arranged to activate the drain pump to remove soil particles from the sump when a predetermined accumulation of soil particles is detected; and a spray arm rotatably mounted above the filter system, wherein the sensor is arranged to detect that the spray arm is rotating and the dishwasher control is arranged to provide a check spray arm signal to the user when the sensor fails to detect spray arm rotation.

3. A dishwasher having a floor and a plurality of walls, a wash pump and a drain pump comprising:

a sump in the floor having a sidewall, a bottom wall with an inlet leading to the wash pump and an inlet leading to the drain pump and a sump conduit extending upwardly from the bottom wall and connected to the outlet of the wash pump;

a filter assembly positioned in the sump over the sump conduit and including:

a generally vertical filter retainer and an overlying perforate hood;

a multiple porosity filter element carried on the filter retainer; and a back wash sprayer rotatably mounted on the sump conduit inside the filter element and having two nozzles directed toward the filter element and vertically spaced on opposite sides of a generally cylindrical hub rotatably carried on the sump conduit, and wherein the sump conduit has one or more openings aligned with the hub to provide a supply of wash water to the back wash sprayer nozzles; and a spray arm rotatably mounted on the sump conduit above the filter assembly, wherein the inlet to the wash pump is positioned inside the filter assembly and the inlet to the drain pump is positioned outside the filter assembly.

4. The dishwasher of claim 3 wherein the filter element has openings that vary in size from top to bottom of the filter element and the size of the openings vary from fine porosity openings at the top and coarse porosity openings at the bottom of the filter element.

5. The dishwasher of claim 4 wherein the size of the filter element openings varies substantially continuously from top to bottom of the filter element.

6. The dishwasher of claim 4 wherein the filter element comprises three vertically arranged bands of differing porosity openings and the top band comprises fine porosity openings, the middle band comprises medium porosity openings, the bottom band comprises coarse porosity openings, and the perforate hood includes a plurality of openings that are greater than or equal to size of the coarse porosity openings of the filter element.

7. The dishwasher of claim 3 wherein the filter retainer is generally cylindrical and comprises a plurality of vertical bars extending from a bottom ring positioned at the bottom wall of the sump to a top ring positioned adjacent the perforate hood.

8. The dishwasher of claim 3 wherein the sump extends downwardly from an opening in the floor of the dishwasher and the perforate hood overlies the opening in the floor and defines an inlet into the space between the filter element and the opening in the floor of the sump, and wherein the bottom wall of the sump defines a ramped channel between the sidewall of the sump and the filter element and the inlet to the drain pump is positioned at the low point of the ramped surface.

9. The dishwasher of claim 3 further including a dishwasher control, and a sensor positioned in the sump to detect accumulation of soil particles on the filter element and connected to the dishwasher control and arranged to activate the drain pump to remove soil particles from the sump when a predetermined accumulation of soil particles is detected.

10. A dishwasher having a floor and a plurality of side walls, a wash pump and a drain pump, the floor and plurality of sidewalls define a drawer having a mounting cavity for the wash pump at one corner and a mounting cavity for the drain pump at another corner, the dishwasher comprising:

a sump in the floor having a sidewall, a bottom wall with an inlet leading to the wash pump and an inlet leading to the drain pump and a sump conduit extending upwardly from the bottom wall and connected to the outlet of the wash pump;

a wash pump inlet conduit connecting the wash pump inlet to the wash pump;

a wash pump outlet conduit connecting the wash pump to the sump conduit;

a drain pump inlet conduit connecting the drain pump inlet to the drain pump;

a filter assembly positioned in the sump over the sump conduit and including:

a generally vertical filter retainer and an overlying perforate hood;

a multiple porosity filter element carried on the filter retainer; and a back wash sprayer rotatably mounted on the sump conduit inside the filter element and having at least one backwash nozzle directed toward the filter element; and a spray arm rotatably mounted on the sump conduit above the filter assembly;

wherein the inlet to the wash pump is positioned inside the filter assembly and the inlet to the drain pump is positioned outside the filter assembly.

11. The dishwasher of claim 10 wherein the wash pump and drain pump are arranged to plug in to the wash pump mounting cavity and drain pump mounting cavity.

12. The dishwasher of claim 11 wherein the wash pump inlet and outlet conduits and the drain pump inlet conduit each includes a self sealing grommet to seal the respective conduits to the wash pump and the drain pump.

13. A dishwasher having a floor and a plurality of walls, a wash pump and a drain pump comprising:

a sump in the floor having a sidewall, a bottom wall with an inlet leading to the wash pump and an inlet leading to the drain pump and a sump conduit extending upwardly from the bottom wall and connected to the outlet of the wash pump;

a filter assembly positioned in the sump over the sump conduit and including:

a generally vertical filter retainer and an overlying perforate hood;

a multiple porosity filter element carried on the filter retainer; and a back wash sprayer rotatably mounted on the sump conduit inside the filter element and having at least one backwash nozzle directed toward the filter element; and a spray arm rotatably mounted on the sump conduit above the filter assembly, the spray arm comprising a top member, a bottom member, and a plurality of nozzles configured to spray wash water in multiple directions, wherein the nozzles are positioned along the inside edge of the top member and the bottom member includes a plurality of diverter channels positioned along the inside edge of the bottom member beneath the plurality of nozzles to divert wash water to the nozzles;

wherein the inlet to the wash pump is positioned inside the filter assembly and the inlet to the drain pump is positioned outside the filter assembly.

14. The dishwasher of claim 13 wherein the spray arm has S shaped arms.

15. The dishwasher of claim 13 wherein the spray arm includes at least one first nozzle on at least one end of the spray arm arranged to spray water in a direction generally parallel to the side wall of the tank and at least one second nozzle on at least one end of the spray arm arranged to spray water in a direction generally perpendicular to the side wall of the tank.

16. The dishwasher of claim 15 wherein the spray arm includes two first nozzles on both ends of the spray arm arranged to spray water in opposite directions generally parallel to the side wall of the tank.

17. The dishwasher of claim 16 wherein the spray arm includes a second nozzle on each end of the spray arm.

18. The dishwasher of claim 9 wherein the sensor is selected from a group including a pressure sensor, a turbidity sensor and an optical sensor.

19. The dishwasher of claim 18 wherein the sensor is a pressure sensor positioned on the sidewall of the sump.

20. A dishwasher having a floor and a plurality of walls, a wash pump and a drain pump comprising:

a sump in the floor having a sidewall, a bottom wall with an inlet leading to the wash pump and an inlet leading to the drain pump and a sump conduit extending upwardly from the bottom wall and connected to the outlet of the wash pump;

a filter assembly positioned in the sump over the sump conduit and including:

a generally vertical filter retainer and an overlying perforate hood;

a multiple porosity filter element carried on the filter retainer; and a back wash sprayer rotatably mounted on the sump conduit inside the filter element and having at least one backwash nozzle directed toward the filter element;

a spray arm rotatably mounted on the sump conduit above the filter assembly, wherein the inlet to the wash pump is positioned inside the filter assembly and the inlet to the drain pump is positioned outside the filter assembly; and a dishwasher control, and a pressure sensor positioned on the sidewall of the sump to detect accumulation of soil particles on the filter element and connected to the dishwasher control and arranged to activate the drain pump to remove soil particles from the sump when a predetermined accumulation of soil particles is detected, the sensor being arranged to detect that the back wash sprayer is rotating and the dishwasher control is arranged to provide a check filter signal to the user when the sensor fails to detect back wash sprayer rotation.

21. The dishwasher of claim 20 wherein the drain pump includes a soil management system positioned to comminute soil particles prior to entry into the drain pump after the soil particles leave the sump.

22. The dishwasher of claim 21 wherein the soil management system comprises a rotating chopping member and a stationary slicing plate positioned in the drain pump inlet.

* * * * *